United States Patent [19]

Harriman

[11] 4,189,353

[45] Feb. 19, 1980

[54] METHOD AND DEVICE FOR TRANSMITTING CONFIDENTIAL INFORMATION THROUGH THE MAIL

[76] Inventor: Russell H. Harriman, 30335 Woodhaven, Birmingham, Mich. 48010

[21] Appl. No.: 905,989

[22] Filed: May 15, 1978

Related U.S. Application Data

[63] Continuation-in-part of Ser. No. 742,769, Nov. 18, 1976, abandoned.

[51] Int. Cl.[2] ..... B42D 15/00

[52] U.S. Cl. ..... 283/6

[58] Field of Search ..... 35/9 H; 282/23 R; 283/6, 11, 17, 58

[56] References Cited

U.S. PATENT DOCUMENTS

| | | | |
|---|---|---|---|
| 1,946,751 | 2/1934 | McCarthy | 283/58 |
| 2,365,716 | 12/1944 | Metzner | 283/6 |
| 3,126,211 | 3/1964 | Hieken et al. | 283/6 |
| 3,281,960 | 11/1966 | Gross | 35/9 H |
| 3,497,242 | 2/1970 | Seidman | 283/58 |
| 4,033,611 | 7/1977 | Johnsen | 283/6 |

*Primary Examiner*—Paul A. Bell
*Attorney, Agent, or Firm*—Robert B. Gerhardt

[57] ABSTRACT

A device and method for transmitting selected confidential information from an institution to a plurality of parties using post cards that have a preprinted camouflage pattern printed in a first predetermined color, confidential information imprinted in a second predetermined color by the institution, printing the name and address of each second party on their respective card, sending the card through the mail to each second party and the second party viewing the information through a filter medium that freely transmits the first predetermined color and renders the information printed in the second color darker than the camouflage pattern. The card may be formed by printing the confidential information on a continuous form printer then detaching individual sections, folding in half and securing the halves together to fabricate a postcard sized and thickness form and then mailing the form to the respective second party at post card postage rates.

3 Claims, 7 Drawing Figures

METHOD AND DEVICE FOR TRANSMITTING CONFIDENTIAL INFORMATION THROUGH THE MAIL

This application is a continuation-in-part of U.S. application Ser. No. 742,769 filed Nov. 18, 1976 entitled, METHOD AND DEVICE FOR TRANSMITTING DEPOSIT INFORMATION, now abandoned.

This invention relates to confidential information transmission devices and method of using the same and more particularly to a method utilizing a novel post card form that enables selective intelligent information to be sent by one party to another with means to enable viewing of the information by the other party.

Because of the convenience and other advantages there has been an increase in the use of the mail by depositors and financial, educational and other institutions to transmit information back and forth concerning the deposit of monies in financial accounts as well as other information. The sending of a receipt through the mail to the account owner or other proper person is always done when the money deposit has been mailed to the financial institution by the account holder. It is more and more also done after deposits by third parties to banks such as deposits of social security payments by the government, pension funds, payroll deposits, etc.

The normal method of sending such deposit information and other confidential information through the mail is to imprint the amount and date on a form or receipt and send the same in a separate envelope. The envelope and enclosed form is sent by first class postage. The several necessary manual steps involve considerable labor expense, the form and envelope involve additional material expenses and the postage finally adds a substantial amount to the total cost.

Other confidential data or information such as student grades, amounts due on accounts, etc. are also now sent inside of envelopes to conceal the data from those except the intended receiver. Again extra parts must be prepared and first class postage used. Where the data to be transmitted is prepared by a computer and printed by a high-speed computer printer, expensive multi-part forms are used to reduce or eliminate the labor of folding, stuffing and sealing the form containing the data in an envelope having the name and address of the person to whom the information is being sent.

On the other hand, if the financial amount and date or other confidential information directly imprinted on the mailing device such as a post card, eg. a government post card, wherein the postage includes the cost of the card itself, there would be a substantial savings of both labor, materials and postage. The problem is that such confidential information as printed on the exposed face of a post card is readily readable by anyone seeing the card. Thus, the desired privacy of information would normally be destroyed by such exposure.

It is therefore an object of this invention to provide a method of transmitting confidential information from one institutional party to a plurality of second parties which utilizes a novel device and procedure of using the same wherein only a single self-contained form and mailing device such as a post card is used to transmit private information and yet will not readily expose such information to unauthorized or casual observers.

A further object of the invention is to provide an information transmission device that has a camouflage background portion upon which the imprinted deposit information becomes normally non-distinguishable without aid.

It is still another object of the invention to provide such a receipt device to be used in combination with a filter device operable to render the camouflage background lighter than imprinted receipt information.

These and other objects and advantages will be readily apparent from the following description and accompanying drawings in which.

Figure 1:
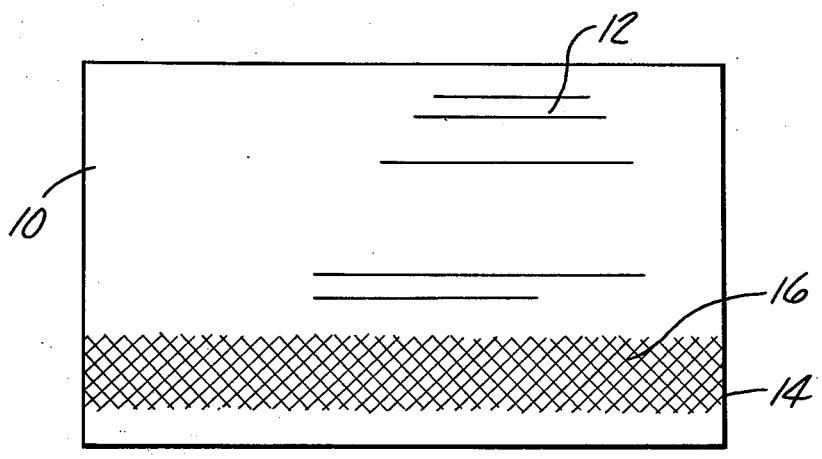
FIG. 1 illustrates on a reduced scale a receipt with a camouflage portion.
Figure 2:
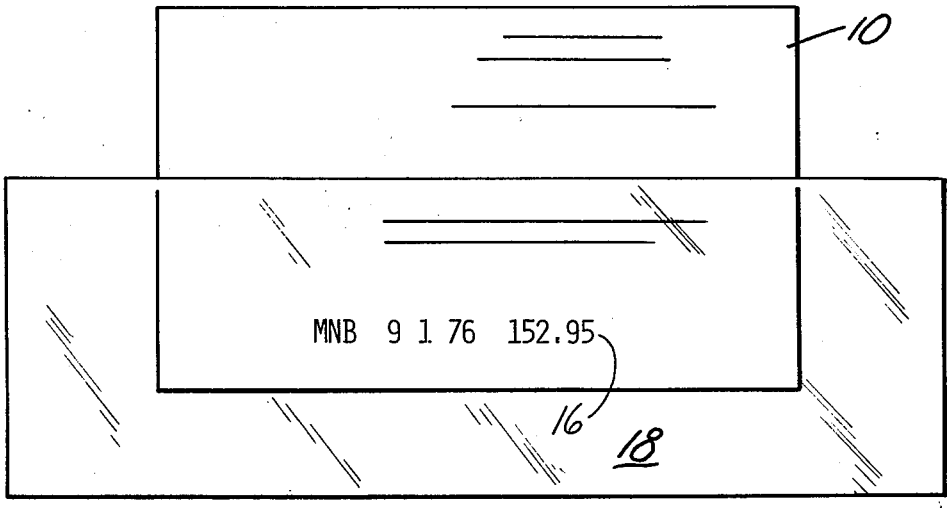
FIG. 2 illustrates the post card of FIG. 1 as viewed through a filter medium and rendering receipt information readily readable.
Figure 3:
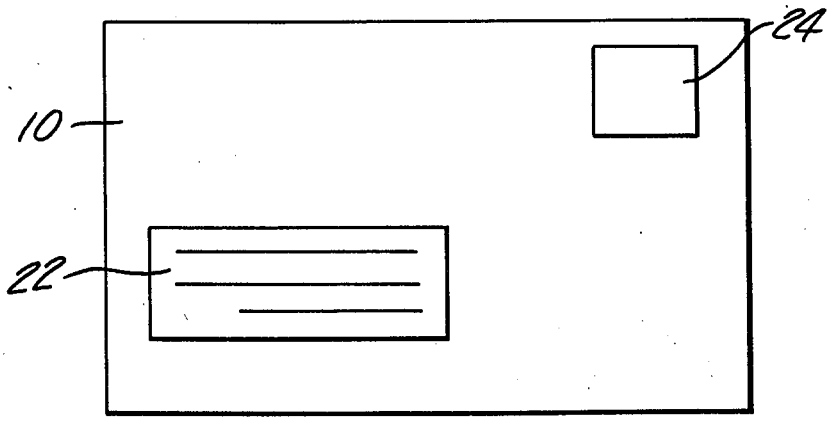
FIG. 3 shows the reverse side of the post card of FIGS. 1 and 3.
Figure 4:
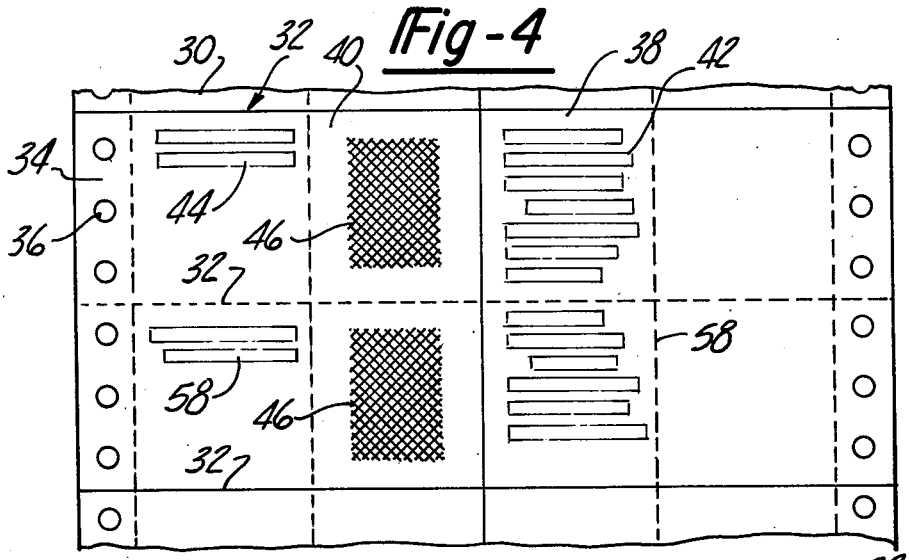
FIG. 4 illustrates another embodiment of the invention using a continuous form having preprinted information thereon.

One embodiment of the invention comprises, as shown in FIGS. 1 to 3, an information transmission procedure utilizing a novel device in the form of a post card 10 on which various information may be preprinted by an educational institution, bank or other institution. The reverse face of the card has imprinted thereon the institution's name and other preprinted descriptive information 12. A camouflage or disguising printed area 16 is printed on one side of the card in a suitable color such as red. While the red ink used should have a rather narrow frequency range, for example about 50 angstrom units wide, the exact frequency range is not critical. The exact design printed may be a random pattern of geometric designs, numbers, alphabetic letters or other similar symbols. The pattern should preferably include printed symbols about the same size as the numbers and letters to be imprinted by the institution on the card.

The front face of the post card may have official government preprinted postage 24 thereon, or optionally a stamp may be affixed by the sender or a postage meter used to imprint the postage. The advantage of the government preprinted card is obvious since the postage cost includes the cost of the card and no extra steps are needed to affix the postage.

The front face of the post card also includes the usual address area on which the name and address of the account holder is entered. The use of a preprinted label provides one simple low cost means of addressing the card.

The selected information such as the date, deposit amount and teller number are imprinted on the card by a conventional adding machine imprinter used by financial institutions. These machines use inked ribbons and the present invention should be imprinted with a color having a color frequency sufficiently different from the color frequency of the camouflage printed design to be rendered black when viewed through a transparent filter medium 18. It has been found that green works quite well.

The filter 18 has a relatively narrow transmission frequency range selected to render the background printed area 16 light and the imprinted receipt information dark in contrast to the background. Thus, if the background camouflage design 16 is of a particular red color the filter should freely transmit that color, but restrict transmission of other colors especially the color of ink of the imprinted receipt information.

By using the subject invention the bank or other institution can at minimum material and labor cost transmit the selected information to the proper party. Because of the concealment effects of the printed background 14, the desired privacy of the information is retained even though the information has been printed on the exposed face of a post card.

Even though it would appear possible for unauthorized third parties to decipher or read the information by utilizing a filter medium of the correct color, those persons actually having visual access to the card, including post office personnel, would not readily have such a filter available when they are handling the cards. The same would be true of third persons located at the address of the post card receipt. The main purpose is to prevent casual or unpremeditated reading of the information.

Another embodiment of the invention is shown in FIGS. 4 to 7. In this embodiment a continuous form generally designated 32 includes a plurality of sections 30 joined at a perforation 32. Detachable end sections 34 are also connected to the ends of the main sections by perforations. Pin holes 36 are used to advance the paper form through a continuous form feeder, the forms part of a conventional high-speed printer device.

Each main section 30 includes a left-hand half 40 and a right-hand half 38. Preprinted information 42 and 44 is printed on the form as shown. This information is information peculiar to the form but common to all parties receiving the form. A camouflage background 46 preferably red, similar to the background 16 of the device of FIGS. 1 to 3 is also preprinted on each section of the continuous form. The printed matter 42 and 44 may be the same color as the camouflage matter 46 or may be in another color. In any case the matter 46 should be in color such as green suitable for rendering additional matter printed thereon in another color unintelligible without a filter medium such as 18 (FIG. 2).

Figure 5:
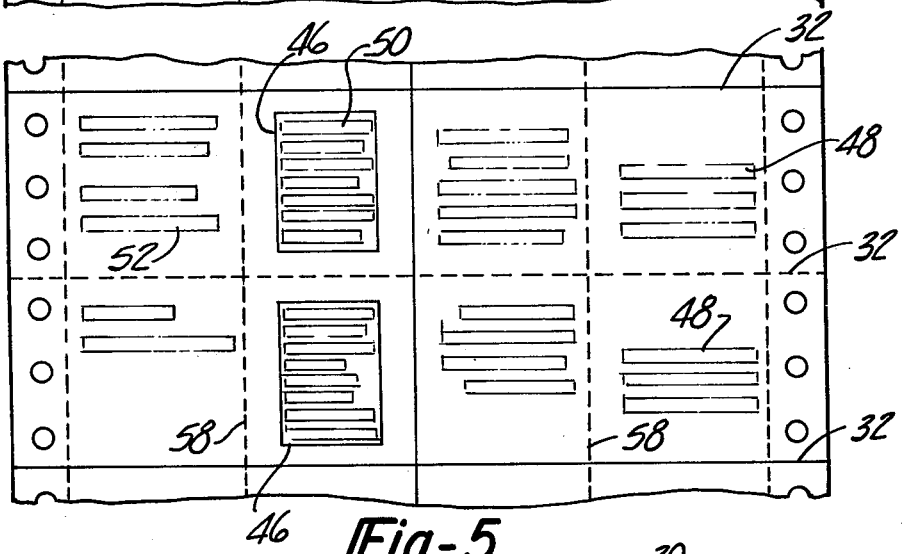
FIG. 5 shows the continuous form of FIG. 4 with selective information printed on each individual section of the form.

FIG. 5 shows the form 32 after it has passed through a high-speed continuous form printer which utilizes information supplied by a computer or other information source to print selectable information pertaining only to each second party. The selectable information may include both private or confidential information such as financial amounts, student grades etc. and non-confidential information such as account numbers, account types, course names and in addition name and address information shown printed at 48. The printed information is printed using a ribbon of the proper color such as green to render the selectable information concealed against the background unless read through a red filter such as 18.

Figure 7:
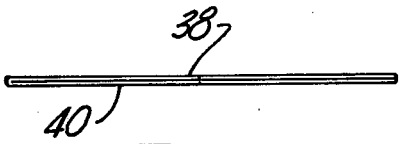
FIG. 7 shows an end view of the finished form after securing the halves of the FIG. 6 form together.
Figure 6:
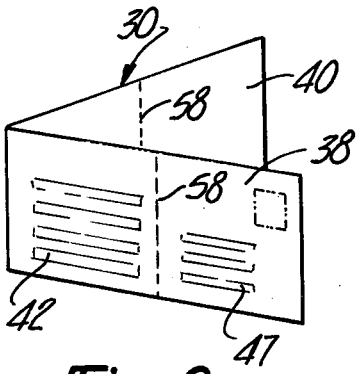
FIG. 6 shows a perspective view of a section of the form of FIG. 5 after separation from other sections and partially folded.

After the form 32 has the final information printed thereon the sections 30 are separated or burst from each other and the end-perforated sections 34. The sections are then folded in half by any suitable mechanical or manual means and fastened together to form a double thickness post card size finished form. The forms can be coated with a material that is wet, or heated or otherwise treated to cause the halves to be permanently fastened together. FIG. 6 shows a single form 30 in a half folded condition while FIG. 7 shows an end view of the finished form ready for mailing.

The sealing or fastening of the halves 38 and 40 can be done before separation of the individual sections or after such separation. Likewise the end perforated sections 34 can be separated before or after the sealing of the parts 38 and 40.

Proper postage is applied to the card above and to the right of the name and address and the finished card mailed. As in the case of the device of FIGS. 1 to 3 the selected confidential information is not readily readable by casual observers but the receiver second parties can each read this information using the filter medium which is supplied by the institution. For example, in the case of sending student grades to students using the subject invention, the student activity or identification card can either be attached thereto or otherwise be carried with a small filter both easily carried in the users pocket or wallet.

In order that the finished device be mailable at post card rates it must meet a number of conditions. The thickness must be between 0.007 and 0.0095 inches; the width between 5 and 6 inches and the height between 3½ and 4¼ inches. In addition the right half of the address side of the device must not contain any information other than the address, return address and postage.

Modifications and changes in the subject post card receipt may be readily apparent to those skilled in the art and such changes and modifications are deemed to be within the scope of the invention which is limited only by the following claims.

I claim:

1. A device for conveying confidential information through the mail at post card rates from a first party to a plurality of second parties, said form made by first printing information common to all the second parties on the form, printing a camouflage background portion in one predetermined color on one part of the form, printing selectable specific information pertaining only to individual second parties on said form, a portion of said selectable information comprising printing said confidential information over said predetermined color, said colors selected so that when the confidential information is viewed by said second party through a transparent filter medium of a color similar to the first predetermined color the confidential information is rendered intelligent to the second party but when viewed by anyone without the filter medium the confidential information is unintelligent.

2. The device of claim 1 wherein the device has a thickness between 0.007 and 0.0095 inches, a width between 5 and 6 inches and a height between 3½ and 4¼ inches.

3. A method of transmitting specific confidential information from a first party to a plurality of second parties comprising the steps of preprinting information common to all of the second parties on a plurality of post card size forms, applying a colored background camouflage to the form at a specific location thereon, determination of the specific confidential information for each individual second party, printing said specific information over the background camouflage in a predetermined color, printing the name and address of the party to whom the specific confidential information relates on said form, mailing said forms to the respective second parties, viewing the forms through a colored filter that renders the specific confidential information readable to the respective second parties.

* * * * *